US010422223B2

(12) United States Patent
Crompton et al.

(10) Patent No.: US 10,422,223 B2
(45) Date of Patent: Sep. 24, 2019

(54) MESH SUPPORTING ROCK ANCHOR

(71) Applicant: NCM INNOVATIONS (PTY) LTD., Johannesburg (ZA)

(72) Inventors: Brendan Robert Crompton, Johannesburg (ZA); Rhys Herbert, Johannesburg (ZA)

(73) Assignee: NCM INNOVATIONS (PTY) LTD., Johannesburg (ZA)

( * ) Notice: Subject to any disclaimer, the term of this patent is extended or adjusted under 35 U.S.C. 154(b) by 0 days.

(21) Appl. No.: 15/781,379

(22) PCT Filed: Dec. 7, 2016

(86) PCT No.: PCT/ZA2016/000032

§ 371 (c)(1),
(2) Date: Jun. 4, 2018

(87) PCT Pub. No.: WO2017/100806

PCT Pub. Date: Jun. 15, 2017

(65) Prior Publication Data

US 2018/0355719 A1 Dec. 13, 2018

(30) Foreign Application Priority Data

Dec. 10, 2015 (ZA) ..... 2015/09000

(51) Int. Cl.
*E21D 11/15* (2006.01)
*E21D 21/00* (2006.01)

(52) U.S. Cl.
CPC ..... *E21D 11/152* (2013.01); *E21D 21/0093* (2013.01)

(58) Field of Classification Search
CPC ..... E21D 11/152; E21D 21/0093
See application file for complete search history.

(56) References Cited

U.S. PATENT DOCUMENTS 2,525,198 A * 10/1950 Beijl ..... E21D 21/008 405/259.3
4,740,111 A 4/1988 Gagnon
4,911,594 A * 3/1990 Fisher ..... F16B 37/02 411/247
4,938,631 A * 7/1990 Maechtle ..... E04G 23/0222 405/259.5
4,984,937 A 1/1991 Karpellus
5,207,535 A 5/1993 Saab
6,004,077 A * 12/1999 Saab ..... E21D 21/0086 405/288
7,478,986 B2 * 1/2009 Bushell ..... F16B 35/041 411/197

(Continued)

OTHER PUBLICATIONS

International Search Report, PCT/ZA2016/000032, dated May 9, 2017.

*Primary Examiner* — Benjamin F Fiorello
(74) *Attorney, Agent, or Firm* — Young & Thompson

(57) ABSTRACT

Disclosed is a rock bolt assembly for installing a mesh panel against a rock face which includes a rock bolt which has an elongate body extending between a first end and a second end, a cylindrical bush engaged with the bolt body, towards the second end, the cylindrical bush having a plurality of annular or arcuate grooves formed in an exterior of the surface of the bush and a washer having a plate-like body with an aperture formed there through.

2 Claims, 2 Drawing Sheets

(56) References Cited

U.S. PATENT DOCUMENTS

| | | | | |
|---|---|---|---|---|
| 2004/0194422 | A1 | 10/2004 | Rodenhouse | |
| 2006/0038729 | A1* | 2/2006 | Ohno | H01Q 1/3275 343/713 |
| 2012/0163924 | A1* | 6/2012 | Rataj | E21D 21/0033 405/259.3 |
| 2013/0336725 | A1 | 12/2013 | Maltby et al. | |

* cited by examiner

MESH SUPPORTING ROCK ANCHOR

BACKGROUND OF THE INVENTION

The invention relates to a rock bolt for supporting a mesh panel that is installed post the installation of the rock bolt.

In mine safety installations, typically a rock bolt array is installed into a rock face by drilling holes into the rock face and installing, into each, an appropriately configured rock bolt. The rock face is supported by a faceplate that is engaged with the rock bolt and installed against the rock face, kept in place by a nut or the like.

Often, after the installation of the rock bolts, it is necessary to further secure the rock face against the possibility of rock fall by installing a plurality of mesh panels against the particular rock face. To do this, a second plurality of rock bolts, or any other suitable device, is installed into or on the rock face. However, it would be beneficial to use the pre-installed rock bolts.

To use a pre-installed rock bolt array, the aperture of a mesh washer, typically, is passed over a projecting end of the rock bolt and moved along the rock bolt to abut the mesh and sandwich the mesh between the faceplate and the rock wall. However, to keep the washer in place and prevent it from sliding off, the washer relies upon a friction grip between the perimeter edge of the washer aperture and the outer surface of the rock bolt. Often this frictional force is insufficient to keep the second washer in load support of the mesh.

The invention at least partially solves the aforementioned problem.

SUMMARY OF INVENTION

The invention provides, in a first aspect, a rock bolt assembly for installing a mesh panel against a rock face which includes a rock bolt which has an elongate body extending between a first end and a second end, a cylindrical bush engaged with the bolt body, towards the second end, the cylindrical bush having a plurality of annular or arcuate grooves formed in an exterior of the surface of the bush and a washer having a plate-like body with an aperture formed there through.

The aperture of the washer may present a circumferential array of resiliently deformable teeth, each of which is integrally formed with the plate-like body.

In the second aspect, the invention provides a rock bolt which has an elongate body which extends between a first end and a second end and a cylindrical bush attached to the rock bolt at or towards the second end, the bush having a plurality of spaced grooves formed in an exterior surface of the bush.

The bush may be swaged and/or welded to the body.

BRIEF DESCRIPTION OF THE DRAWINGS

The invention is further described by way of example with reference to the accompanying drawing in which.

DESCRIPTION OF PREFERRED EMBODIMENT

Figure 1:
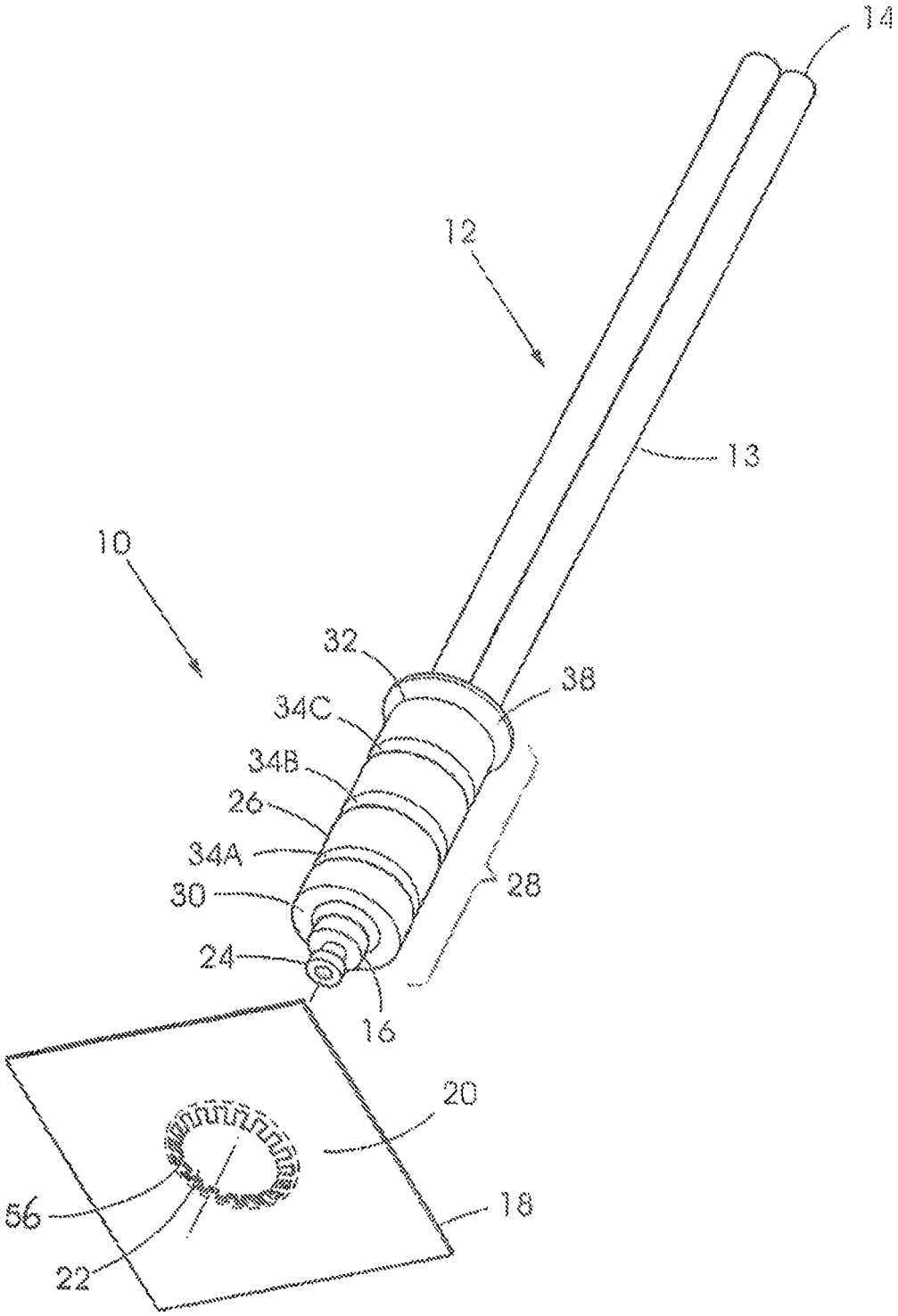
FIG. 1 is an isometric view of a rock bolt assembly according to the invention.

FIG. 1 illustrates a rock bolt assembly 10, in accordance with the invention, which includes a rock bolt 12 having an elongate body 13 which extends between a distal end 14 and a proximal end 16, and a mesh washer 18.

The rock bolt 12 can be a solid rod-like groutable bolt or a hydraulically inflatable rock bolt or the like.

The mesh washer has a square or rectangular plate-like body 20 centrally through which an aperture 22 is formed.

In this particular non-limiting example, the rock bolt 12 is a hydraulically inflatable bolt in which the body defines an enclosure into which water, under pressure, is inserted through a filler nozzle inlet 24, attached to the proximal end 16, to which a filler nozzle (not shown) of a hydraulic filler device attaches.

The rock bolt 12 includes a cylindrical bush 26 which is engaged over a proximal end section 28 of the bolt body and then swaged and/or welded in place. The bush extends between a first end 30 and a second end 32.

The bush 26 has a plurality of annular grooves, respectively designated 34A, 34B and 34C, formed in an outer surface 36 of the bush.

Each of the grooves are regularly spaced in the longitudinal direction.

The bush presents a laterally projecting lip 38 at its second end 32.

Figure 2:
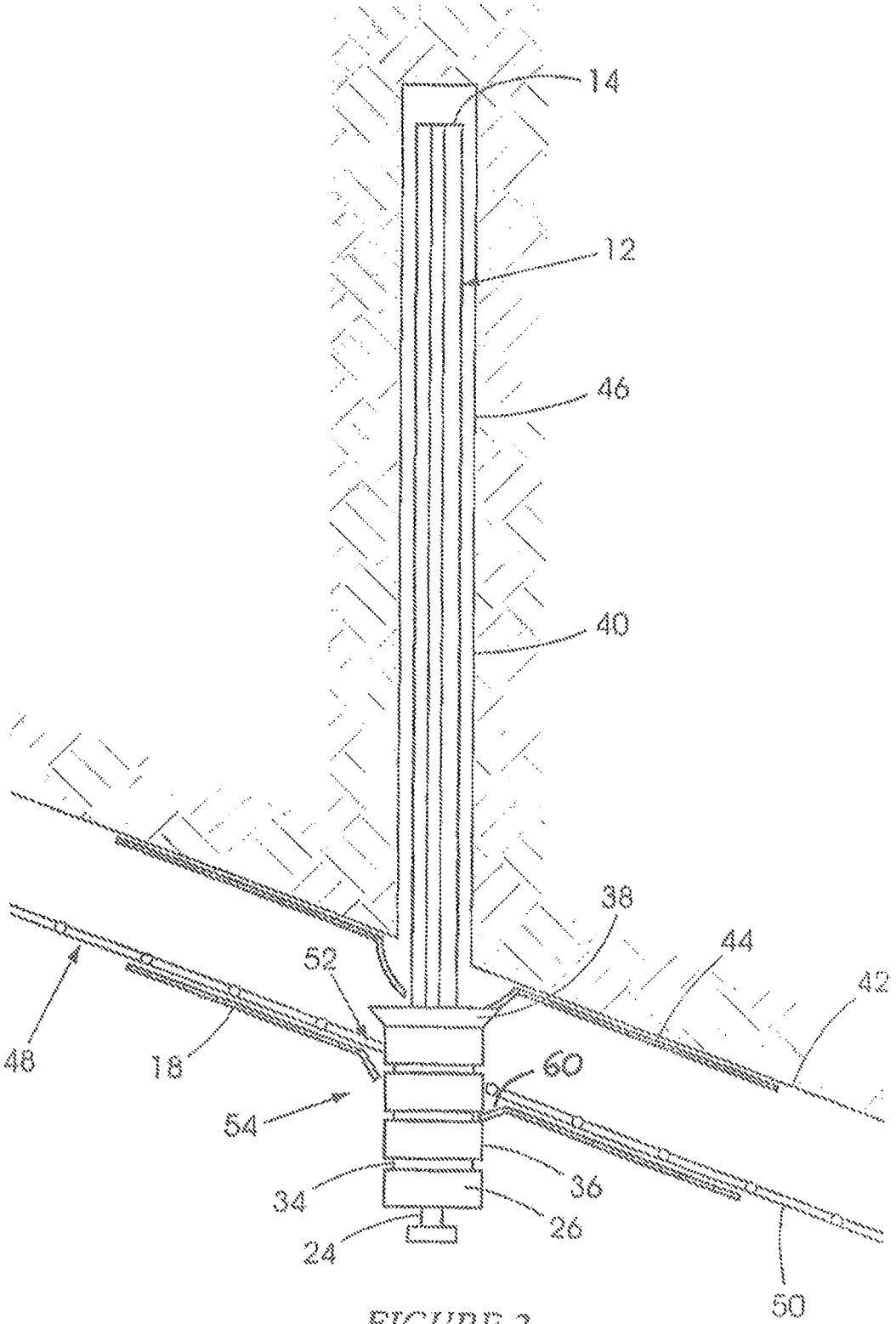
FIG. 2 diagrammatically represents the rock bolt assembly of FIG. 1 installed in a rock hole in support of a mesh panel.

The use of the rock bolt 16, as illustrated in FIG. 2, the bolt body 13 is inserted into a pre-drilled rock hole 40 in a wall 42 of an excavation with a first faceplate 44 located on the bolt body between the lip 38 and the distal end 14.

With the faceplate 44 forced against the wall 42 by the abutting lip 38, the bolt body is hydraulically inflated into resistive contact with the rock hole walls 46 to, ultimately, provide load support to the wall 42 through the faceplate 44.

Thereafter, a mesh panel 48, made of a plurality of orthogonally arranged steel elements 50 to provide a plurality of orthogonal mesh apertures 52, is engaged to one or more of these pre-installed rock bolts 12 to attach the mesh panel adjacent the rock wall 42.

This is repeated with a plurality of mesh panels and pre-installed rock bolts 12 to provide a safety barrier to rock fall from the wall 42.

To engage the mesh panel 48 as described, an aperture 52 of the mesh panel is passed over a projecting end 54 of the rock bolt, carrying the bush 26. A second washer, being the mesh washer 18 with a circumferential array of resiliently deformable teeth 56 which are integrally formed with the aperture 22, is now used. The washer is engaged with the rock bolt 12 by passing the proximal end 16 of the bolt body through the aperture and moving the washer along the bush, towards the mesh panel, in a ratcheting manner, with the array of teeth resiliently outwardly deforming to accommodate this passage.

When the washer 44 is finally in place, on the bush, abutting the mesh panel 40, the teeth resistively engage the bush to prevent the washer moving backwardly, towards the proximal end 16, keeping the panel 40 in place adjacent the wall 36.

The annular grooves enhance this resistive contact by providing abutting surfaces for the resistive purchase of the teeth 56.

As illustrated in FIG. 2, typically the rock bolt 12 is installed at an angle to the plane of the wall 42. In a standard installation the outer surface of the rock bolt is smooth and the washer is kept engaged with the rock bolt merely by the friction grip of the perimeter edge of the washer aperture with the rock bolt. In an angular installation, a problem is experienced where, due to the pivoted position of the washer 44, load is applied unevenly to the teeth 56 of the aperture 22. The teeth on this one side of the aperture (designated 60 on FIG. 2) experience load that exceeds the omit of elastic deformation of the teeth. Thus, these teeth plastically deform to a permanently deformed state.

The teeth about this side 60 no longer apply a frictional force to the rock bolt. The washer is now rendered functionally inutile and is prone to slide off the rock bolt.

By providing the bush 26 with the annular grooves 34, in accordance with the invention, this problem is overcome. The applicant has found that in installations where the washer is angled at up to 20° from perpendicular axis, there is sufficient frictional engagement of the teeth with the bush to maintain adequate load support, despite the washer being plastically deformed in the manner described above.

Two sets of tests were performed on a notional rock bolt installation using a washer 44 and a grooved bush 26. The tests were performed with a test jig a driving tool to drive a grooved bush through an angled washer to represent the washer being obliquely installed on the bush in support of the mesh panel 48. The assembly is then turned over and a load is applied to the other end of the bush to represent the washer, in use, with load applied on the washer by the mesh panel.

In the first set of tests, the washer was installed at a 20° angle to the bush to resemble an angled installation in situ. In the second set of tests, the washer initially was engaged to the bush at 20° and then moved to 0°, perpendicular to the axis of the notional bolt.

The results of these test are tabulated below:

TABLE 1

| Set A | Thickness of washer (cm) | Load (kN) |
|---|---|---|
| 1 | 1.6 | 25.14 |
| 2 | 1.6 | 30.69 |
| 3 | 1.6 | 18.66 |
| 4 | 1.6 | 22.83 |
| 5 | 1.6 | 21.86 |

TABLE 2

| Set B | Thickness of washer | Load (kN) |
|---|---|---|
| 1 | 1.6 | 24.11 |
| 2 | 1.6 | 20.39 |
| 3 | 1.6 | 25.12 |
| 4 | 1.6 | 23.92 |
| 5 | 1.6 | 19.23 |

The minimum ultimate strength achieved in these tests is 18.66 kN, more than enough to support a mesh panel 48 when in use and considerably higher than expected.

The invention claimed is:

1. A rock bolt assembly for installing a mesh panel against a rock face, the rock bolt assembly comprising:

a rock bolt which has an elongate body extending between a first end and a second end, a cylindrical bush engaged with the bolt body, towards the second end of the bolt body, the cylindrical bush having a plurality of spaced apart annular or arcuate grooves formed in an exterior of surface of the cylindrical bush, and a washer having a plate-like body which has an aperture and a circumferential array of resiliently deformable teeth integrally formed with the plate-like body about the aperture, the deformable teeth of the washer arranged for resistive engagement with the grooves formed in the exterior of the surface of the cylindrical bush to thereby prevent the washer from moving backwards towards the second end of the bolt body.

2. A rock bolt assembly for installing a mesh panel against a rock face, the rock bolt assembly comprising:

a rock bolt with an elongate bolt body extending between a first distal end and a second proximal end;

a cylindrical bush engaged with the second proximal end of the bolt body, the cylindrical bush having a first end located nearest the first distal end of the rock bolt and a second end located nearest the second proximal end of the rock bolt;

the cylindrical bush having a plurality of annular grooves formed in an exterior of surface of the cylindrical bush, the plurality of annular grooves including first, second, and third annular grooves spaced apart in a longitudinal direction of the cylindrical bush, the first annular groove spaced apart from the second annular groove, and the second annular groove being spaced apart from and the third annual groove;

a laterally projecting lip located at the first end of the cylindrical bush located nearest the first distal end of the rock bolt; and a faceplate located on the bolt body between the laterally projecting lip and the first distal end of the rock bolt, the faceplate having a first side arranged to be forced against a wall by the laterally projecting lip abutting against a second side of the faceplate; and a washer having a plate body which has an aperture and a circumferential array of deformable teeth integrally formed with the plate body about the aperture, wherein, in use with the washer obliquely arranged with respect to a longitudinal axis of the cylindrical bush, the deformable teeth resistively engage the cylindrical bush by engaging with resistive contact one of the annular grooves to prevent the washer from moving backwards towards the second proximal end of the bolt body, the one of the annular grooves providing an abutting surface for resistive purchase of the deformable teeth therein to thereby have the washer be kept engaged with the rock bolt by friction grip and plastic deformation of the deformable teeth at the one of the annular grooves providing the abutting surface for resistive purchase of the deformable teeth.

* * * * *